US011367348B2

(12) United States Patent
Yang et al.

(10) Patent No.: US 11,367,348 B2
(45) Date of Patent: Jun. 21, 2022

(54) DISTRIBUTED HEARING SYSTEM FOR USE WITH TRAFFIC SIGNALS

(71) Applicant: OTOUSA, INC., Rowland Heights, CA (US)

(72) Inventors: Shun-Hau Yang, Taoyuan (TW); Yen-Sheng Chen, Taoyuan (TW); Song-Lian Hong, Taoyuan (TW)

(73) Assignee: OTOUSA, INC., Rowland Heights, CA (US)

( * ) Notice: Subject to any disclaimer, the term of this patent is extended or adjusted under 35 U.S.C. 154(b) by 0 days.

(21) Appl. No.: 16/701,434

(22) Filed: Dec. 3, 2019

(65) Prior Publication Data

US 2021/0158694 A1 May 27, 2021

Related U.S. Application Data

(63) Continuation of application No. PCT/US2019/063509, filed on Nov. 27, 2019.

(51) Int. Cl.
*G08G 1/04* (2006.01)
*G08G 1/01* (2006.01)
(Continued)

(52) U.S. Cl.
CPC ..... *G08G 1/04* (2013.01); *G08G 1/0116* (2013.01); *G08G 1/0137* (2013.01); *G08G 1/0965* (2013.01); *H04R 3/00* (2013.01)

(58) Field of Classification Search
CPC ..... G08G 1/087; G08G 1/0965; G08G 1/08; G08G 1/0955; G08G 1/0129; G08G 1/017;
(Continued)

(56) References Cited

U.S. PATENT DOCUMENTS 4,806,931 A * 2/1989 Nelson ..... G01V 1/001 340/902
5,014,052 A * 5/1991 Obeck ..... G08G 1/087 340/906
(Continued)

FOREIGN PATENT DOCUMENTS

TW I581203 5/2017
TW I627612 6/2018
(Continued)

OTHER PUBLICATIONS

Taiwan Patent Office "Office Action" dated Sep. 24, 2020, Taiwan.
(Continued)

*Primary Examiner* — Dionne Pendleton
(74) *Attorney, Agent, or Firm* — WPAT, PC

(57) ABSTRACT

A distributed hearing system includes a plurality of near audio probe modules distributed at a plurality of specified locations in a specified area for recording audio information at the specified locations in the specified area, respectively; and a central data collecting/analysis/control module in communication with the plurality of near audio probe modules for collecting and analyzing the audio information from the plurality of near audio probe modules. The audio information is generated by a vehicle and includes a characteristic feature specific to the vehicle. A traffic control method is used with the distributed hearing system.

4 Claims, 5 Drawing Sheets

(51) Int. Cl.
*H04R 3/00* (2006.01)
*G08G 1/0965* (2006.01)

(58) Field of Classification Search
CPC .... G08G 1/09; G08G 1/095; G08G 1/096716; G08G 1/096758; G08G 1/096775; G08G 1/096791; G08G 1/0968; G08G 1/096805; G08G 1/096883; G08G 1/096894; G08G 1/123; G08G 1/144; G08G 1/148; G08G 1/161; G08G 1/162; G08G 1/163; G08G 1/167; G08G 1/20; G08G 1/22; G08G 1/202; G08G 1/07; G08G 1/096725; G08G 1/096783; G08G 1/143; G08G 1/146; G08G 1/164; G08G 1/166; G08G 1/205; G08G 1/005; G08G 1/0112; G08G 1/0116; G08G 1/081; G08G 1/165; G08G 1/0133; G08G 1/0145; G08G 1/09626; G08G 1/127; G01V 1/001; H04R 2430/20; H04R 2460/07; H04R 2499/13; H04R 29/005; Y02T 10/70; Y02T 10/7072; Y02T 90/12; Y02T 10/64; Y02T 10/72; Y02T 90/16; B60P 3/12; B60Q 9/00; F02N 11/0807; F02N 11/101; F02N 2200/123; F02N 2300/306; G01B 21/00; G01S 19/13; G01S 19/215; G01S 19/42; G01S 5/22; G05B 15/02; G05B 23/0245; G06N 20/00; G07C 1/10; G07C 5/006; G07C 5/008; G07C 5/0808; G07C 5/0816; G07C 9/00; G07C 9/37; G08B 21/00; G08B 21/18; G08B 25/014; H04N 5/74; Y02D 30/70; G01C 21/3407; G01C 21/3415; G01C 21/3423; G01C 21/343; G01C 21/3438; G01C 21/3453; G01C 21/3461; G01C 21/3605; G01C 21/3617; G01C 21/362; G01C 21/3661; G01C 21/3664; G01C 21/3685; G01C 21/3697; G01C 21/30; G01C 21/3469; G01C 21/3492; G01C 21/3691; G01C 21/005; G01C 21/32; G01C 21/34; H04H 20/59; H04H 20/34; H04H 20/36; H04H 20/61; H04H 2201/13; H04H 60/13; B60R 25/252; B60R 25/255; B60R 16/0234; B60R 16/037; B60R 2021/0027; B60R 2021/01013; B60R 2025/1013; B60R 21/0136; B60R 21/34; B60R 2300/8006; B60R 2325/101; B60R 25/04; B60R 25/10; B60R 25/102; B60R 25/257; B60R 25/305; B60R 25/31; B60R 25/24; B60R 25/25; B60W 30/095; B60W 30/0956; B60W 30/12; B60W 30/16; B60W 30/18009; B60W 30/18163; B60W 50/0098; B60W 50/10; B60W 50/14; B60W 60/001; B60W 60/0017; B60W 2040/0809; B60W 40/08; B60W 40/04; B60W 60/00253; B60W 10/04; B60W 10/18; B60W 10/20; B60W 2050/146; B60W 2420/54; B60W 2420/60; B60W 2540/22; B60W 2540/221; B60W 2556/45; B60W 2556/50; B60W 30/06; B60W 30/09; G06F 21/32; G06F 16/2455; G06F 16/29; G06F 17/00; G06F 21/44; G06F 21/606; H04L 67/12; H04L 12/2803; H04L 12/2816; H04L 12/2825; H04L 63/1466; H04L 67/18; H04L 67/22; H04L 9/32; B60L 58/12; B60L 15/20; B60L 2240/547; B60L 2240/60; B60L 2250/16; B60L 53/36; G06K 9/00255; G06K 9/00281; G06K 9/00362; G06K 9/0061; G06K 9/00617; G06K 9/00979; G06K 9/627; G06K 9/6293; G06K 9/00288; G06K 9/00791; G06K 9/00832; G06K 9/00087; G06K 9/00006; G05D 1/0088; G05D 2201/0213; G05D 1/0027; G05D 1/021; G05D 1/0016; G05D 1/0214; G05D 1/0293; G05D 1/0297; G05D 2201/0212; G05D 1/0011; G05D 1/0061; G05D 1/0212; G05D 1/0231; G05D 1/0246; G05D 1/0255; G05D 1/0257; G05D 1/0276; G05D 1/0285; G05D 1/0287; G05D 1/0289; G05D 1/0295; H04W 4/40; H04W 4/025; H04W 4/02; H04W 4/44; H04W 4/023; H04W 4/029; H04W 4/33; H04W 4/46; H04W 12/06; H04W 12/08; H04W 12/104; H04W 12/122; H04W 12/61; H04W 12/63; H04W 4/024; H04W 4/06; H04W 4/20; H04W 4/80; H04W 4/90; H04W 72/005; H04W 84/005; H04W 88/02; H04W 8/22; H04W 4/021; H04W 4/21; G06Q 50/30; G06Q 10/02; G06Q 10/20; G06Q 10/00; G06Q 10/047; G06Q 10/06; G06Q 10/1095; G06Q 30/0621; G06Q 30/0641; G06Q 40/08; H02J 4/00; H04B 1/59

See application file for complete search history.

(56) References Cited

U.S. PATENT DOCUMENTS

| | | | | |
|---|---|---|---|---|
| 8,094,040 | B1 * | 1/2012 | Cornett | G08G 1/087 340/902 |
| 2013/0142347 | A1 * | 6/2013 | Lord | H04R 29/005 381/58 |
| 2013/0328700 | A1 * | 12/2013 | Ibrahim | G08G 1/0955 340/907 |
| 2015/0149617 | A1 | 5/2015 | Lai | |
| 2022/0013008 | A1 * | 1/2022 | Katz | H04W 4/38 |

FOREIGN PATENT DOCUMENTS

| | | |
|---|---|---|
| TW | M566808 | 9/2018 |
| TW | M570325 | 11/2018 |
| TW | M594778 | 5/2020 |

OTHER PUBLICATIONS

Taiwan Patent Office "Office Action" dated Jul. 12, 2021, Taiwan.

* cited by examiner

DISTRIBUTED HEARING SYSTEM FOR USE WITH TRAFFIC SIGNALS

FIELD OF THE INVENTION

The present invention relates to a traffic control method, and more particularly to a traffic control method for use with a distributed hearing system.

BACKGROUND OF THE INVENTION

Because of dense population and frequent activities, it is necessary to collect information associated with the activities of residents and make judgments and decisions based on the collected information for good urban governance. Conventionally, video information has been collected and analyzed in a variety of urban governance applications. However, there should be audio information, in addition to video information, highly correlated to daily lives of residents. Unfortunately, only has video information been practically applied to urban governance, and it is still insufficient for creating a full-fledged system. Therefore, it is desirable to make use of audio information.

Generally, audio information may be originated from fixed audio signal sources and mobile audio signal sources. For a fixed audio signal source which periodically or constantly makes too much noise, it is not difficult to locate the audio signal source and find evidences of violating law or rules. Therefore, amelioration of noise pollution can be timely and significantly made. However, for a mobile audio signal source which makes loud noise at arbitrary places and time, for example illegally modified car, old vehicle or speeding motorcycle, it is hard to give evidence, or a lot of manpower would be required to collect evidence.

SUMMARY OF THE INVENTION

An object of the present invention is to provide a distributed hearing system for use with traffic signals, which provides audio information feasible for urban governance, and a traffic control method for use with the distributed hearing system.

An aspect of the present invention relates to a distributed hearing system, which includes a plurality of near audio probe modules distributed at a plurality of specified locations in a specified area for recording audio information at the specified locations in the specified area, respectively; and a central data collecting/analysis/control module in communication with the plurality of near audio probe modules for collecting and analyzing the audio information from the plurality of near audio probe modules. The audio information is generated by a vehicle and includes a characteristic feature specific to the vehicle. A traffic control method is used with the distributed hearing system.

In an embodiment, the distributed hearing system is used with traffic signals.

Preferably, the near audio probe modules are installed in traffic signal devices at the specified locations, respectively.

Preferably, the central data collecting/analysis/control module further issues a decision command to one or more of the traffic signal devices to execute a specific operation according to the analyzing result of the audio information. For example, the specific operation is to force the traffic signal device to turn green, or to force the traffic signal device to turn red.

In an embodiment, the audio information is generated by an audio recognition transmitter attached onto the vehicle.

In an embodiment, the correlation of the characteristic feature to the vehicle is previously recorded in a database of the central data collecting/analysis/control module. In another embodiment, the correlation of the characteristic feature to the vehicle is dynamically recorded and inputted into the central data collecting/analysis/control module.

BRIEF DESCRIPTION OF THE DRAWINGS

The invention will become more readily apparent to those ordinarily skilled in the art after reviewing the following detailed description and accompanying drawings, in which.

DETAILED DESCRIPTION OF PREFERRED EMBODIMENTS

The invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The current police system for urban safety has been greatly improved as a result of extensive distribution of street cameras. However, the building cost and the response time of the system are relatively unfavorable as highly computing power is required for processing and analyzing the huge amount of image data, and meanwhile a lot of storage space is required for reserving the image data. In contrast, processing and analysis of audio data are more cost-effective and efficient than those of video data since a sound collecting device such as a microphone is much cheaper than an image collecting device such as a camera, and the performance of a sound collecting device would not be affected by the surrounding factors such as orientation or weather as seriously as an image collecting device. Thus it is advantageous to use audio information in a police system to acquire more quantity of useful and diverse data.

For example, traffic signals have been essential to urban lives, and distributed more and more extensively all over a city due to longer roads and denser traffic network. Therefore, it is desirable to develop a distributed hearing system for use with traffic signals, which collects and makes use of audio data at specified locations, particularly where traffic signal devices are installed, for monitoring.

Figure 1:
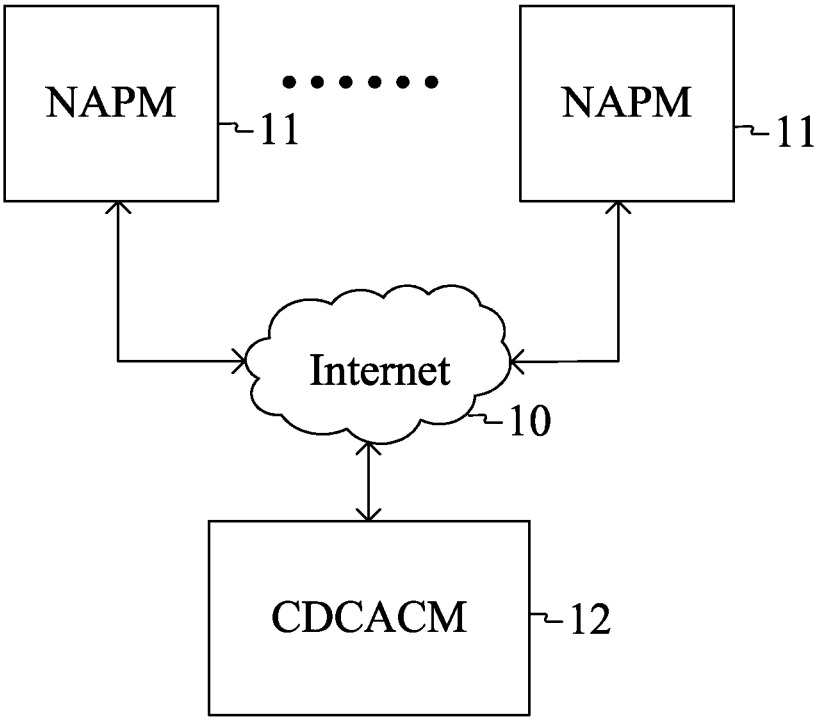
FIG. 1 is a schematic block diagram illustrating a distributed hearing system according to an embodiment of the present invention.

Please refer to FIG. 1, which is a functional block diagram schematically illustrating a distributed hearing system for use with traffic signals according to the present invention. The distributed hearing system includes a near audio probe module (NAPM) 11 and a central data collecting/analysis/ control module (CDCACM) 12 interconnected via Internet 10. NAPM 11 can be installed in traffic signal devices for recording audio information in order to realize characteristic features of recorded audio signals. Once there occurs any traffic event around the specified location, a characteristic feature of an audio signal can be collected and analyzed to provide useful clues. The characteristic features mentioned above may be amplitude and/or frequency data of audio signals. In an embodiment of the present invention, the audio signals are differentially generated from respective audio licenses issued to different cars. In other words, a characteristic feature of an audio signal generated from an audio license issued to a vehicle can be considered as an identification (ID) information of a vehicle. For example, an audio recognition transmitter is attached onto a suitable position of a vehicle. The audio recognition transmitter transmits out an audio carrier signal with the ID information of the vehicle carried thereby. The NAPM 11, once receiving the audio carrier signal with the ID information of the vehicle, demodulates the audio signal to acquire the ID information of the vehicle. It is understood that a plurality of NAPM 11 may be linked with the CDCACM 12 via a network, e.g. a wide area network, a private local network or any other suitable network.

Figure 2A:
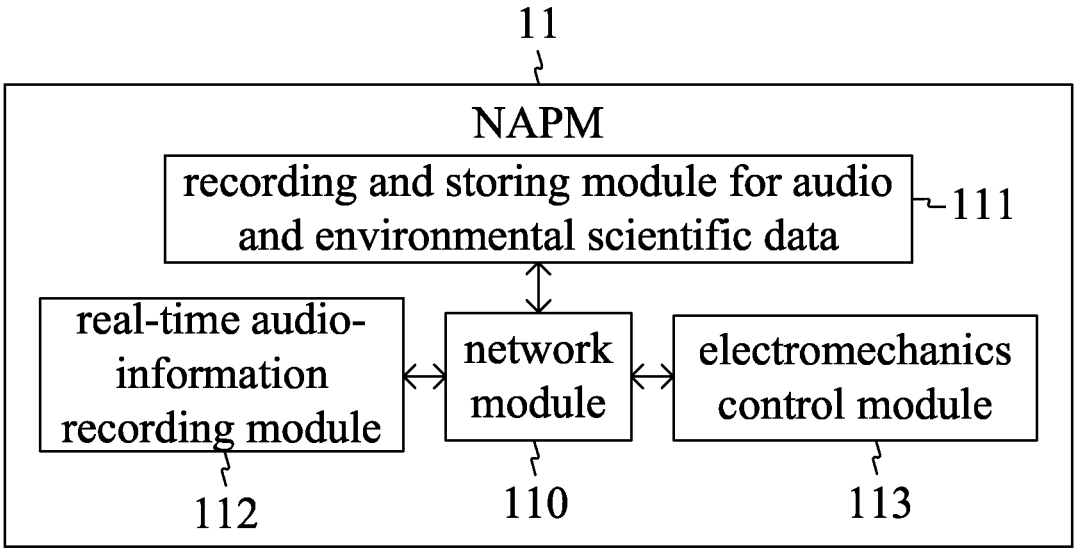
FIG. 2A is a schematic block diagram illustrating a near audio probe module (NAPM) included in the distributed hearing system of FIG. 1.

In an embodiment as illustrated in FIG. 2A, the NAPM 11 includes a network module 110, a recording and storing module 111 for audio and environmental scientific data, a real-time audio-information recording module 112, and an electromechanical control module 113. The network module 110 may be assigned with a fixed IP or a floating IP under 3G/4G/5G communication, and alternatively, with other wireless or wired communication modes, and function for having the NAPM 11 to be passively controlled by or connected to the CDCACM 12 for information transmission. This embodiment is advantageous in avoiding from layout problems of a wired network, and feasible for construction in a wide area.

The recording and storing module 111 for audio and environmental scientific data may be implemented with an assembly of noise meter such as common precise levelled 1/1 and 1/3 octave-band-time analyzer, anemometer, pressure gauge, thermometer and humidity meter and functions for real-time and continuous data recording of audio and environmental scientific data. The real-time audio-information recording module 112 is implemented with a camera with a built-in microphone, an assembly of camera and microphone, a standalone microphone, or any other suitable device that can record audio information and can be passively linked and actuated by the CDCACM 12 to transfer real-time audio data to the CDCACM 12.

The electromechanical control module 113 is implemented with an assembly of control switches for receiving real-time and/or non-real-time control signals generated locally, or passively awaits for control signals transmitted from the CDCACM 12 for controlling a variety of electromechanical devices or transferring the control signals to a control system of traffic signals for associated actions, e.g. forced red light or forced green light.

As for the CDCACM 12, it functions for actively collecting data from the NAPM or NAPMs 11, and storing and analyzing the collected data to obtain a series of decision commands for controlling the NAPM or NAPMs 11 to conduct one or more specific actions. For example, the CDCACM 12 can actively control the electromechanical control module 113 of the NAPM 11 to send a control signal to a control system of traffic signals, thereby forcing the traffic signal to turn into green, for example, when a police car, a fire engine or an ambulance on duty need to urgently cross the intersection. Alternatively, the CDCACM 12 may also actively control the traffic signal to turn into red in order to hinder a suspect vehicle from escaping from the police. It is also feasible to transfer the series of decision commands to another system to execute subsequent processes.

Figure 2B:
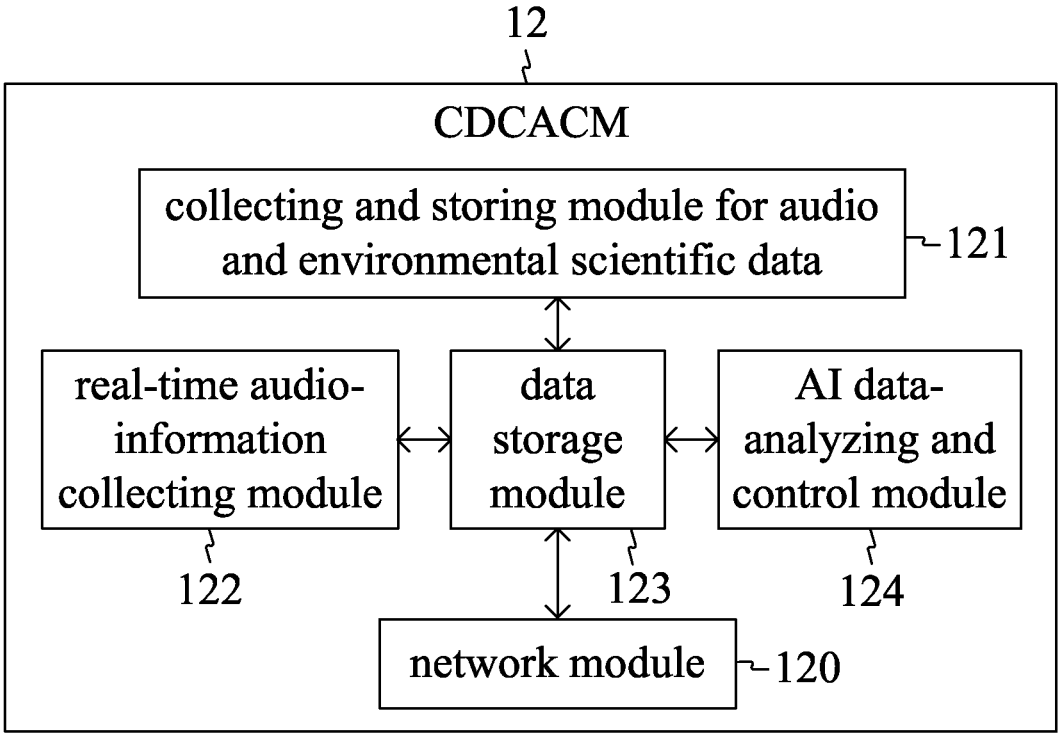
FIG. 2B is a schematic block diagram illustrating a central data collecting/analysis/control module (CDCACM) included in the distributed hearing system of FIG. 1.

As illustrated in FIG. 2B, the CDCACM 12 includes a network module 120, a collecting module 121 for audio and environmental scientific data, a real-time audio data-collecting module 122, a data storage module 123, and an artificial intelligence (AI) data-analyzing and control module 124. The network module 120 is implemented with a wired/wireless network module and functions for allowing the CDCACM 12 to actively issue a signal to the NAPM 11, thereby performing electromechanical control and data collection. The collecting module 121 functions for actively collecting audio and environmental scientific data from the NAPM 11. The collecting module 122 functions for actively collecting real-time audio data recorded by the real-time audio data-collecting module 112 of the NAPM 11. The data storage module 123 stores therein the data that the collecting modules 121 and 122 actively collect from the NAPM 11.

The AI data-analyzing and control module 124 functions for analyzing at least the audio data, and optionally the video data as well, that the collecting modules 121 and 122 actively collect from the NAPM 11 in a real-time, non-real-time or a hybrid real-time/non-real-time manner. In a real-time manner, while the AI data-analyzing and control module 124 are analyzing the audio and/or video data, the AI data-analyzing and control module 124 also operates the collected data after analysis to generate a series of decision commands, and informs of another system to take actions or controls the electromechanical control module 113 of the NAPM 11 accordingly via the network module 120. In the non-real-time manner, the AI data-analyzing and control module 124 picks up data from the data storage module 123 to conduct AI model training. In the hybrid real-time/non-real-time manner, the AI data-analyzing and control module 124 performs the above-mentioned real-time analysis and operation periodically, intermittently or at scheduled time points or time durations.

Figure 3:
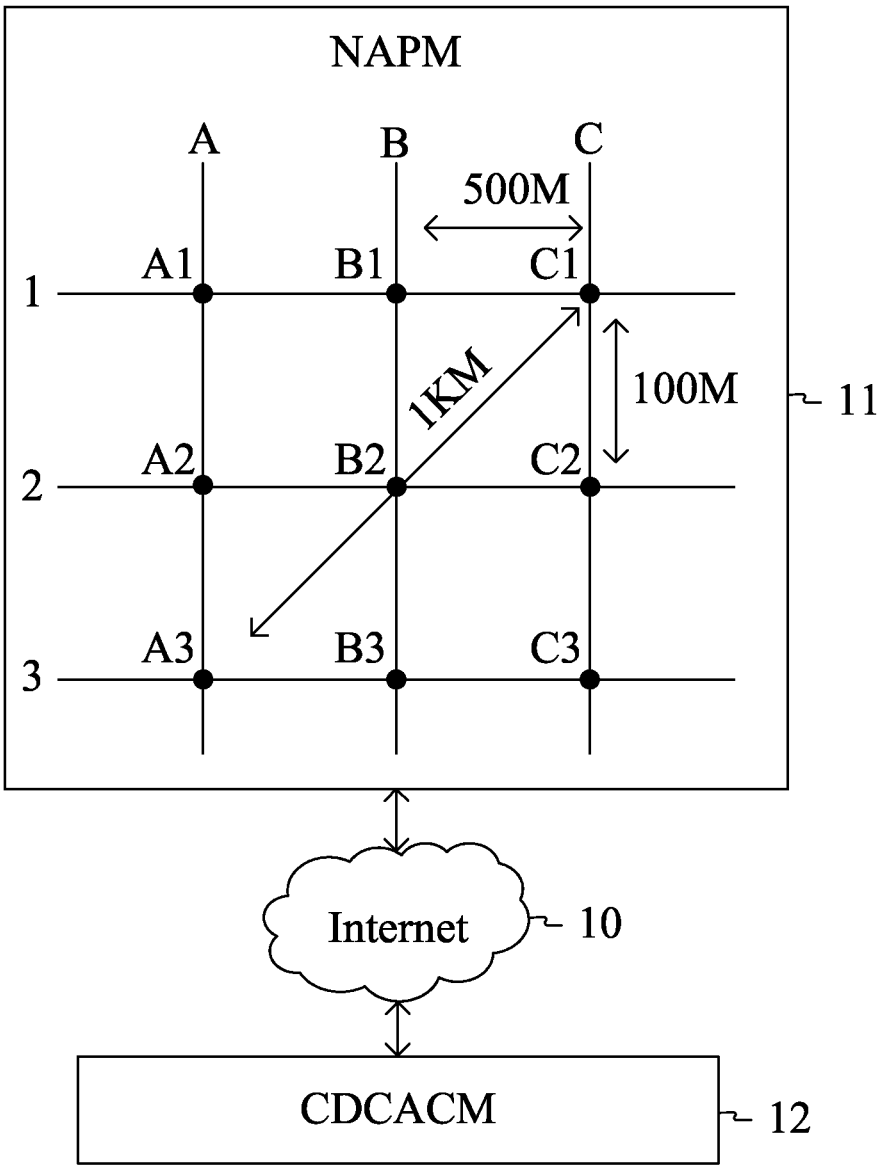
FIG. 3 is an example of the distributed hearing system of FIG. 1 for use with traffic signals.

Please refer to FIG. 3, in which a layout of a distributed hearing system for use with traffic signals according to an embodiment of the present invention is schematically exemplified. As shown, roads A, B and C intersect with roads 1, 2 and 3, and nodes A1, A2, A3, B1, B2, B3, C1, C2 and C3 indicate intersections of the roads. It is to be noted that configuration as shown in FIG. 3 is for illustration only and does not intend to proportionally show the distance relationship among the roads, and the distance of a section between two roads may be tens or hundreds of meters, or even several kilometers. Depending on practical requirements, each traffic signal device disposed at each intersection of roads may be installed with an NAPM 11 for collecting audio information around the intersection. Alternatively, as shown in FIG. 3, only are selected traffic signal devices installed with NAPMs 11. It is to be noted that although the traffic signal devices equipped with the NAPMs 11 are exemplified herein to be allocated at intersections of roads, the traffic signal devices may also be allocated on the roadsides. Furthermore, it is not necessary for the NAPMs 11 to be installed in the traffic signal devices even if it would be a desirable option. Alternatively, they may be installed on any other suitable supporting bases as long as the audio-recording operations can be conducted successfully and accurately. In this way, the audio information can be collected routinely, enduringly, widely and smartly.

Figure 4:
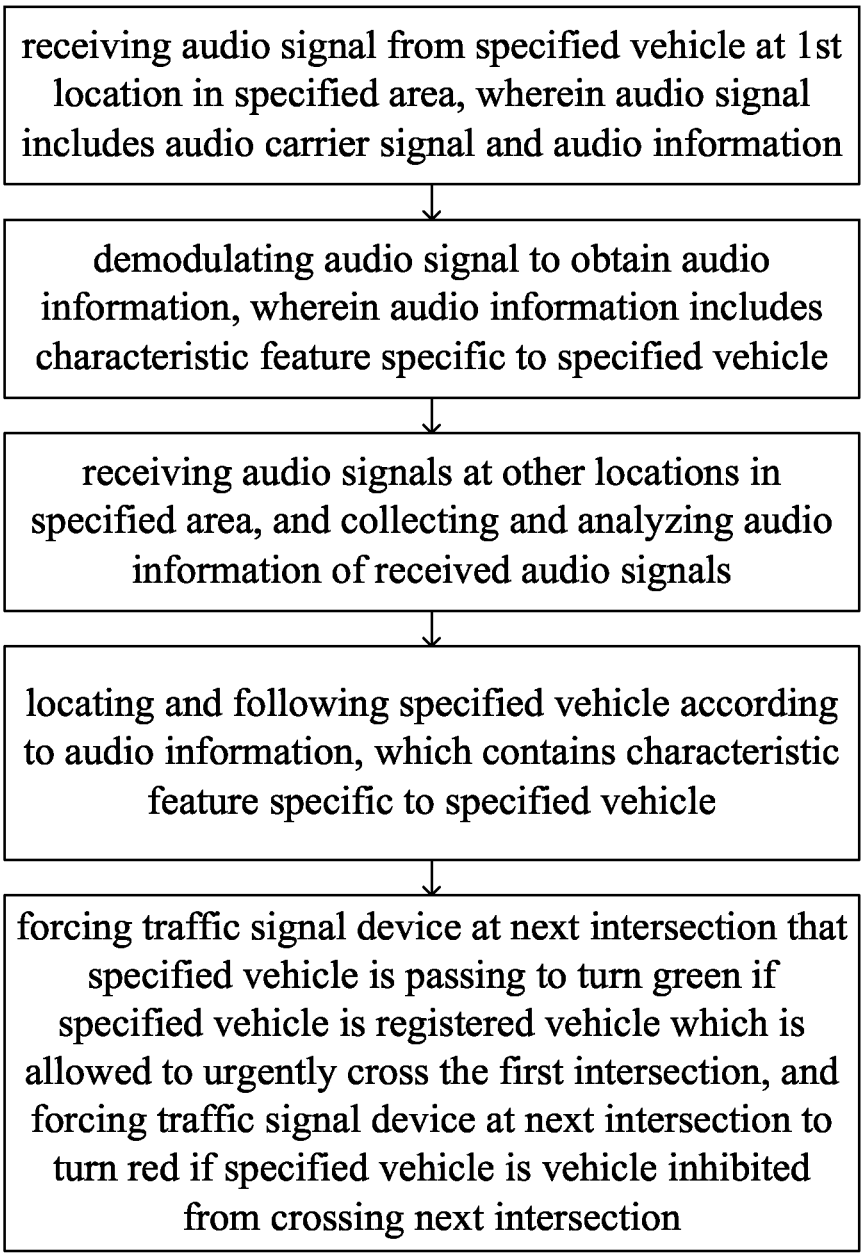
FIG. 4 is a flowchart illustrating a traffic control method for use with a distributed hearing system according to an embodiment of the present invention.
Figure 5:
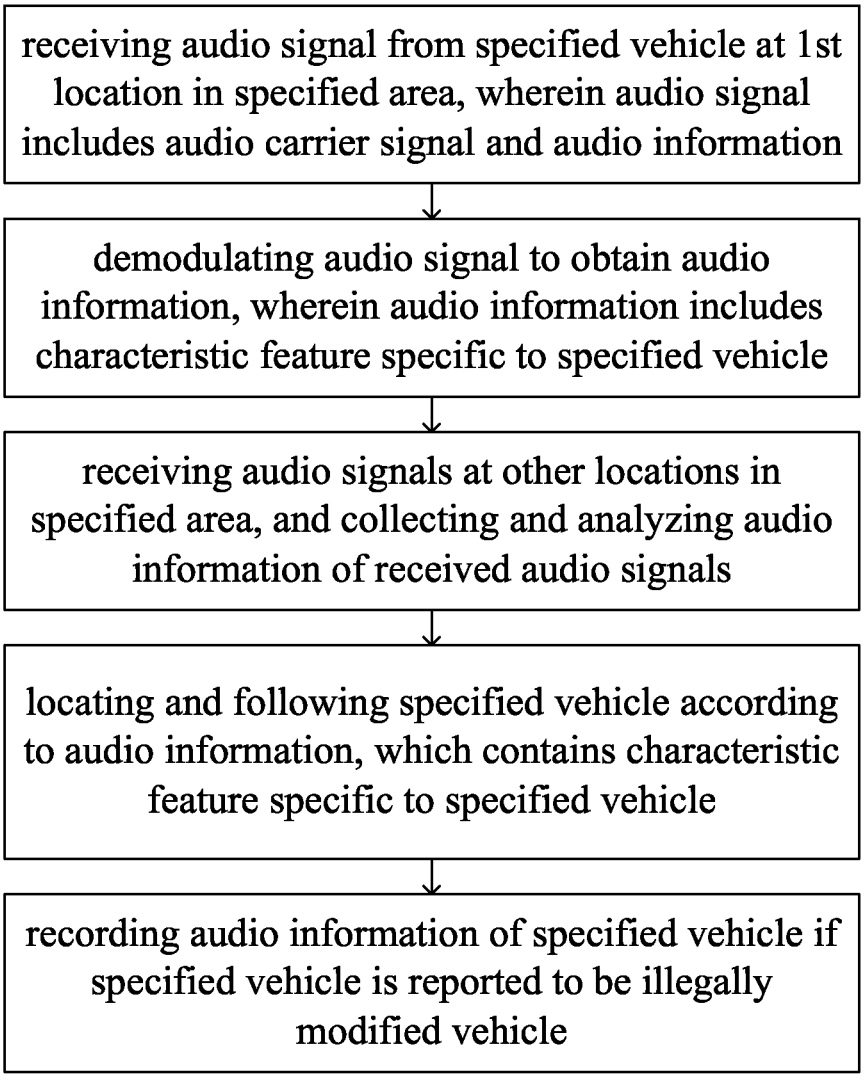
FIG. 5 is a flowchart illustrating a traffic control method for use with a distributed hearing system according to another embodiment of the present invention.

Applications of a distributed hearing system for use with traffic signals developed according to the present invention are exemplified as follows with reference to the flowchart of FIG. 4 and FIG. 5. In an example, a plurality of NAPMs of the distributed hearing system are installed in traffic signal devices at intersections of main roads in a city. When an illegally modified car making too much noise is reported, the audio information recorded by the NAPMs installed at the intersections where the rule-violating car passes can be investigated to acquire evidences. It is particularly powerful if the audio information is combined with video information that has been commonly picked up nowadays, for example, by using a camera built-in with a microphone or an assembly of a camera and a microphone as the NAPM 11. It is understood that the more intensive the NAPMs are allocated, the more detailed the recordation of audio information can be achieved. Taking advantage of advanced mobile communication means, e.g. fifth generation mobile network or fifth generation wireless system (5G), the NAPMs can be allocated not only intensively in urban area but also widely into country area. Furthermore, if the audio data is transmitted by the network module of the NAPM via a 3G/4G/5G dynamic IP, hacker invasion can be effectively prevented. Meanwhile, the dynamic IP of each of the NAPMs is randomly and/or intermittently assigned, so the system can be further protected from hacker invasion.

In another example, the distributed hearing system for traffic signals developed according to the present invention can be used to facilitate traffic control. For example, when a priority vehicle such as a police car, a fire engine or an ambulance is passing through an intersection of roads, it is preferred that the traffic light at the intersection is turned green for the priority vehicle to pass smoothly and safely. With the distributed hearing system for use with traffic signals developed according to the present invention, the route and the approaching of a specified priority vehicle can be identified by recording, collecting and analyzing the audio information of the vehicle based on the characteristic feature of the priority vehicle, which has been filed in advance. Therefore, the associated traffic light can be forced to turn green for the priority vehicle to smoothly and safely pass through the associated intersection.

In the above examples, characteristic features of audio information from registered vehicles are pre-stored in a database. Alternatively, a characteristic feature of audio information from an unidentified vehicle may also be dynamically inputted to the present system. For example, when a police car tails or chases a suspect car, the police uses a mobile audio analyzer for vehicles to record the audio information of the suspect car, and the characteristic feature is extracted from the audio information and stored to the CDCACM of the hearing system. Subsequently, when the CDCACM determines that one or more of the NAPMs distributed along with the road network has recorded the audio information from the suspect car, the suspect car can be located and followed. Moreover, the CDCACM of the hearing system may force one or more traffic lights at the intersection or intersections where the suspect car is passing to turn red so as to hinder the suspect from escaping.

As mentioned above, an audio recognition transmitter specific to a vehicle can be installed onto a suitable position of the vehicle upon leaving factory or upon licensing to serve as an audio ID of the vehicle. An audio ID, compared with a license plate, can be identified more readily since the NAPM does not need to be specifically oriented and is less significantly affected by weather. Moreover, the resource required for processing audio data is much less than that required for processing video data, and thus more audio data than video data can be processed in general cases. Therefore, audio data recordation is relatively effective for busy sections and intersections of roads.

In a further example, the audio information recorded by the present hearing system can be used for research in a variety of fields. By allocating the NAPMs intensively in a specified area, the audio information in the specified area can be collected routinely, enduringly, widely and smartly. The audio information would reflect real and accurate daily situations in the specified area, and has a highly reference value. For example, audio information in a urban area and audio information in a country area can be respectively recorded and analyzed for government's reference to stipulate adaptively. In addition, the audio information would also reflect changes in the specified area, which may be referred to by the government for policy considerations.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A traffic control method for use with a distributed hearing system, the distributed hearing system including a plurality of near audio probe modules distributed at a plurality of locations in a specified area, the method comprising:

receiving an audio signal from a specified vehicle at a first location among the plurality of locations in the specified area, wherein the audio signal includes an audio carrier signal and an audio information carried by the audio carrier signal;

demodulating the audio signal to obtain the audio information, wherein the audio information includes a characteristic feature specific to the specified vehicle;

receiving audio signals at other locations among the plurality of locations in the specified area, and collecting and analyzing the audio information of the received audio signals;

locating and following the specified vehicle according to the audio information, which contains the characteristic feature specific to the specified vehicle; and forcing a traffic signal device at a next intersection that the specified vehicle is passing to turn green if the specified vehicle is a registered vehicle which is allowed to urgently cross the first intersection, and forcing the traffic signal device at the next intersection to turn red if the specified vehicle is a vehicle inhibited from crossing the next intersection.

2. The method according to claim 1, wherein the audio information is analyzed by way of artificial intelligence, and the method further comprises: conducting artificial intelligence training for analyzing the audio information in a real-time, non-real-time or a hybrid real-time/non-real-time manner.

3. The method according to claim 1, wherein the audio information is collected via a fixed IP or a floating IP under 3G/4G/5G communication.

4. A traffic control method for use with a distributed hearing system, the distributed hearing system including a plurality of near audio probe modules distributed at a plurality of locations in a specified area, the method comprising:

receiving an audio signal from a specified vehicle at a first location among the plurality of locations in the specified area, wherein the audio signal includes an audio carrier signal and an audio information carried by the audio carrier signal;

demodulating the audio signal to obtain the audio information, wherein the audio information includes a characteristic feature specific to the specified vehicle;

receiving audio signals at other locations among the plurality of locations in the specified area, and collecting and analyzing the audio information of the received audio signals;

locating and following the specified vehicle according to the audio information, which contains the characteristic feature specific to the specified vehicle; and recording the audio information of the specified vehicle if the specified vehicle is reported to be an illegally modified vehicle.

* * * * *